United States Patent [19]

Renard et al.

[11] Patent Number: 4,984,642

[45] Date of Patent: Jan. 15, 1991

[54] COMPOSITE TOOL COMPRISING A POLYCRYSTALLINE DIAMOND ACTIVE PART

[75] Inventors: Paul Renard, Uriage; Jean Sionnet, Saint Egreve, both of France

[73] Assignee: Société Industrielle de Combustible Nucléaire, Annecy, France

[21] Appl. No.: 441,745

[22] Filed: Nov. 27, 1989

[30] Foreign Application Priority Data

May 17, 1989 [FR] France ..... 89 06435

[51] Int. Cl.[5] ..... E21B 10/46

[52] U.S. Cl. ..... 175/329; 175/410; 407/118

[58] Field of Search ..... 175/329, 409, 410, 411; 125/39; 407/118; 51/293, 295, 297

[56] References Cited

U.S. PATENT DOCUMENTS

| | | | |
|---|---|---|---|
| 4,604,106 | 8/1986 | Hall et al. | 175/329 X |
| 4,858,707 | 8/1989 | Jones et al. | 175/329 |
| 4,872,520 | 10/1989 | Nelson | 175/329 |

FOREIGN PATENT DOCUMENTS

| | | | |
|---|---|---|---|
| 2089415 | 1/1972 | France . | |
| 2380845 | 9/1978 | France . | |
| 1040850 | 11/1984 | U.S.S.R. | 175/329 |
| 1351795 | 11/1987 | U.S.S.R. | 125/39 |

*Primary Examiner*—Ramon S. Britts
*Assistant Examiner*—David J. Bagnell
*Attorney, Agent, or Firm*—Pollock, Vande Sande & Priddy

[57] ABSTRACT

The composite tool (1) comprises a sintered metal carbide support (2) and a polycrystalline diamond active part (3) having an inner surface (4) of metallurgical connection to the support (2) and an outwardly facing working surface (5). The working surface (5) comprises corrugations (7) which are substantially parallel to one another and form successive projecting zones (7) and hollow zone (8) on at leasst a part of the working surface (5). The composite tool is in particular intended for drilling to a great depth, such as drilling oil wells.

4 Claims, 2 Drawing Sheets

COMPOSITE TOOL COMPRISING A POLYCRYSTALLINE DIAMOND ACTIVE PART

FIELD OF THE INVENTION

The invent relates to a composite tool comprising a cemented metal carbide support and a polycrystalline diamond active part.

BACKGROUND OF THE INVENTION

It is known to employ composite tools comprising a polycrystalline diamond active part for effecting machining operations involving mechanical removal of a hard material.

Such tools are employed for drilling rocks in the mining or oil exploitation field, for cutting coal or other natural materials which are extracted, or for machining metals.

Composite tools are known which comprise a support of cemented metal carbide, for example tungsten carbide, and a polycrystalline diamond active part having an inner surface ensuring the connection with the support and an outwardly facing working surface for contacting the material to be machined.

The connection between the polycrystalline diamond active part and the tool support is of the metallurgical connection type usually employing a metal such as cobalt which may also be employed for the connection between the particles of diamond of the active part.

These composite tools are obtained by compacting and sintering methods employing high temperatures and very high pressures.

Composite tools having a diamond-impregnated working surface are advantageously employed in machining operations carried out on rocks, such as drilling, cutting or excavation.

In order to ensure that these operations are carried out in a satisfactory manner, as in any other machining operation involving the removal of material, it is necessary to achieve efficient cooling of the zone of contact between the tool and the material being machined.

There has, for example, been proposed in FR-A-2,089,415 a tool whose active part is constituted by diamond crystals directly interconnected with cobalt, nickel or iron and having a very small volume relative to the volume of the carbide support.

In the case of the drilling of rocks with tools constituted by sintered polycrystalline diamond picks bound by the cobalt, cooling is ensured by the circulation of a fluid which sweeps across the zone of contact between the tool and the rock, i.e., the zone of contact of the working surface of the polycrystalline diamond tool.

Notwithstanding this cooling, the stresses applied to the tool, depending on the type of rock encountered during drilling, may be such that the heating of the active part of the tool becomes excessive and results in thermal degradation of this part of the tool by intergranular cracking or decohesion of the zone of junction between the active part and the support. Consequently, the life of the tools or tool elements having a composite structure is reduced.

It has been proposed in FR-A-2,380,845 provide a network of intercommunicating pores throughout the volume of the tool element constructed in a composite manner, the total volume of the pores being as much as 5 to 30% of the volume of the tool element.

However, such a tool, while its resistance to thermal degradation is improved, has mechanical characteristics which are distinctly inferior to those of composite tools constructed in a dense form and including an active part constituted by particles of polycrystalline diamond bound together with a metal such as cobalt.

The working surfaces of conventional composite tools usually have a rounded shape, the polycrystalline diamond active part usually being hemispherical. This renders the tool very tough, but, when the tool has undergone a certain amount of wear, the cutting efforts have a tendency to increase and this results in increased heating and therefore increased thermal degradation of the active part of the tool.

Furthermore, prior art tools constructed in the composite form usually do not permit easy and rapid break-up and elimination of the cuttings formed by removal of material in the course of the machining. There is consequently an increase in the cutting effort and heating of the tools.

SUMMARY OF THE INVENTION

An object of the invention is therefore to propose a composite tool comprising a metal carbide support and a polycrystalline diamond active part having an inner surface of metallurgical connection to the support and an outwardly directed working surface, which is efficiently cooled in use and is capable of operating with a reduced cutting effort and improves the breaking up and elimination of the cuttings of the machined material.

For this purpose, the working surface of the tool comprises corrugations which are substantially parallel to one another and constitute successive projecting zones and hollow zones on at least a part of the working surface.

BRIEF DESCRIPTION OF THE DRAWINGS

In order to explain how the invention may be carried out, there will now be described, by way of example, with reference to the accompanying drawings, several embodiments of a composite tool according to the invention employed as a pick for the drilling or cutting of rocks.

In the drawings.

DESCRIPTION OF PREFERRED EMBODIMENT

Figure 1:
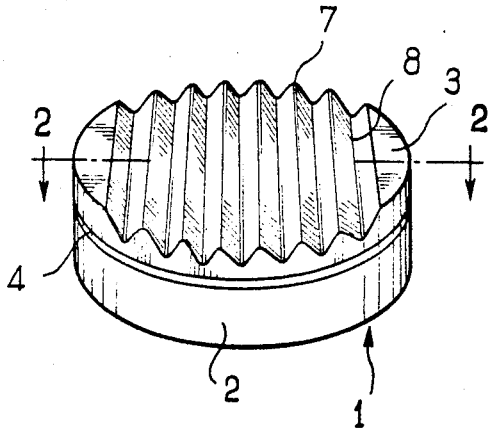
FIG. 1 is a perspective view of a first embodiment of a composite tool.

FIG. 1 shows a composite tool 1 according to the invention having a generally cylindrical shape. The tool 1 comprises a cemented tungsten carbide support 2 and an active part 3 of polycrystalline diamond constituted by compacted and sintered diamond particles enclosing a certain proportion of cobalt constituting a binder.

The active part 3 is connected to the support 2 by a very thin metallurgical junction layer 4 which may be formed by cobalt coming, by the effect of diffusion, from the support of tungsten carbide based on cobalt, or from a source of cobalt previously deposited on the support. It may also be constituted by a mixture of grains of diamond, cobalt powder and tungsten carbide. In this case, the layer 4 constitutes a barrier to diffusion between the active part of polycrystalline diamond (or PCD) and the tungsten carbide support.

Figure 2:
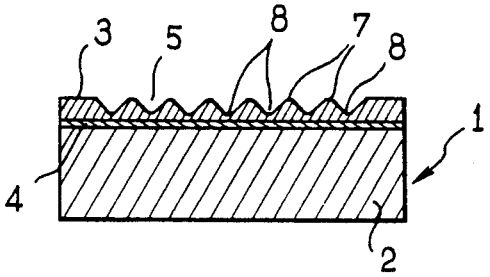
FIG. 2 is a sectional view taken on line 2—2 of FIG. 1.

The support of cemented tungsten carbide (usually formed by particles of tungsten carbide which have been sintered and bound together by the cobalt), the polycrystalline diamond active part 3 of the tool and the metallurgical connection layer 4 are seen in particular in FIG. 2 which is a section of the tool in a diametrical plane.

The end parts of the working surface of the outwardly facing active part opposed to the junction surface are contained in a plane whose trace 5 is shown in FIG. 2.

According to the invention, the polycrystalline diamond active part 3 of the tool includes successive substantially parallel corrugations 7 having identical cross-sectional shapes. These cross-sectional shapes are equilateral triangles having a slightly rounded apex.

The working surface of the tool is therefore a planar surface having equally spaced apart, rectilinear and parallel teeth.

The corrugations 7 constitute the projecting portions of the working surface which are separated by the hollow portions 8.

Preferably, in the case of a pick having a diameter of 19 mm for drilling oil wells, the corrugations have a depth of 0.6 mm, their crests being spaced apart by a distance of 2 mm and the overall thickness of the active part is 1.5 mm. When the tool according to the present invention is used with a cutting liquid which is made to circulate in such manner as to sweep across the working surface of the tool in contact with the material being machined, the discontinuity of this working surface resulting from the corrugations 7 creates a zone of turbulence in the circulation of the cutting liquid. This turbulent behavior brought about by the corrugations 7 notably improves the efficiency of the cooling liquid by facilitating the thermal exchanges between the working surface and the surface of the material being machined. Moreover, this turbulent behavior promotes the dissipation of the heat of the particles of material which are removed by the tool during machining and heated under the effect of the forces involved.

The presence of the corrugations on the working surface of the tool therefore results in a substantial improvement in the performances of the tool owing to improved cooling of the zone being machined and of the active part of the tool.

Furthermore, as a result of the presence of the corrugations 7, the pressure points between the zones of contact of the working surface of the tool and the material being machined are considerably increased throughout the life of the tool.

It is therefore possible to reduce the power required to be applied to the tool or to improve the performance and in particular the cutting power of the tool for a given power.

The overall heating of the active part of the tool is therefore less than in the case of a tool of rounded shape having a hemispherical working surface. In this way, the thermal degradation of the active part of the tool is reduced and retarded.

Furthermore, the presence of corrugations or teeth on the working surface of the tool promotes the breakup of the cuttings of material being machined, which are torn away by the cutting tool. These cuttings are indeed subjected in the course of machining to a force exceeding their shear strength in an appropriate direction.

The reduction in the size of the cuttings limits the heating resulting from their elimination which is due in particular to the friction of the cuttings on the working surface of the tool.

This advantage is particularly noticeable in the case where the cuttings or fragments of material are difficult to discharge, and in particular in the drilling of rocks to great depths, for example in the case of drilling oil wells.

Figure 3:
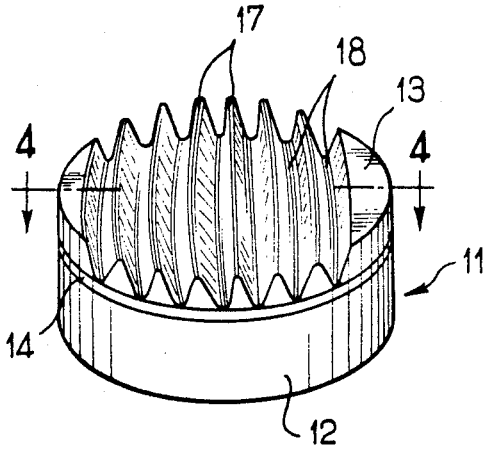
FIG. 3 is a perspective view of a tool according to a second embodiment of the invention.
Figure 4:
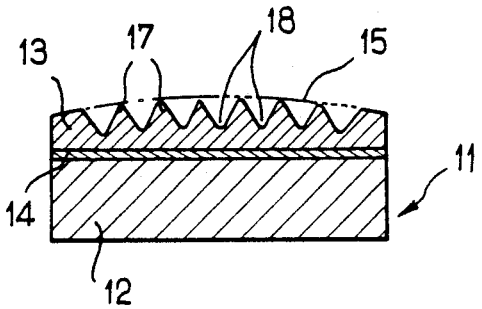
FIG. 4 is a sectional view taken on line 4—4 of FIG. 3.

FIGS. 3 and 4 show a second embodiment of a tool or tool element according to the invention.

The tool 11 comprises a support 12 of cemented tungsten carbide constituted by particles of sintered tungsten carbide bound together by cobalt and an active part 13 of polycrystalline diamond obtained by sintering at very high temperature and very high pressure particles of diamond in the presence of cobalt employed as the binder and catalyst.

The polycrystalline diamond active part 13 is connected to the support 12 by a metallurgical junction layer 14 produced during the simultaneous treatment at high temperature and high pressure of the support and the active part constituting the tool.

The general structure of the tool represented in FIGS. 3 and 4 is consequently similar to the structure of the tool represented in FIGS. 1 and 2.

However, the envelope 15 of the working surface of the tool, i.e., the surface joining the end parts of this outwardly facing working surface, has the shape of a spherical dome, rather than being planar.

The working surface of the active part 13 of the tool, i.e., the surface of the active part facing outwardly and opposed to the internal layer 14 of junction with the support, has successive corrugations 17 which are substantially parallel and equally spaced apart from one another so that the whole of the working surface is formed by projecting portions corresponding to the corrugations 7 and hollow portions 18 separating the corrugations.

The corrugations 17 and the hollow portions 18 have longitudinal sections in the shape of arcs of a circle corresponding to the shape of the spherical dome 15.

As in the case of the embodiment shown in FIGS. 1 and 2, the corrugations 17 have, in cross section, the shape of a triangle whose apex is slightly rounded.

In the case of a tool or tool element having a diameter of 13mm for drilling oil wells, the height of the corrugations in the radial direction of the spherical dome 15 is 0.6 mm, the distance between the crests of two successive corrugations is 2 mm and the overall thickness of the active part is 1.5 mm.

Figure 5:
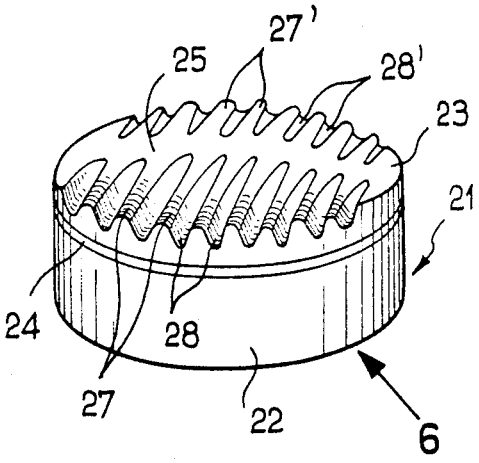
FIG. 5 is a perspective view of a tool according to a third embodiment of the invention.
Figure 6:
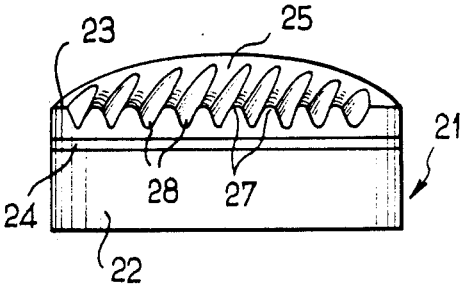
FIG. 6 is a side elevational view in the direction of arrow 6 of FIG. 5.

Shown in FIGS. 5 and 6 is a third embodiment of a tool or tool element according to the invention.

This tool 21 comprises, as before, a cemented tungsten carbide support 22, an active part 23 of polycrystalline diamond sintered with a metal such as cobalt and a metallurgical junction layer 24 between the active part 23 and the support 22.

The working surface 25 of the active part 23, i.e., the surface of this active part facing outwardly and opposed to the junction layer 24, has the shape of a spherical dome.

In this embodiment of the invention, the working surface 25 has two groups of corrugations 27, 27'' in two diametrically opposed outer zones separated by a smooth central zone constituting the top of the spherical dome 25.

As before, the corrugations 27 (or 27') define projecting portions of the working surface 25 separated by hollow portions 28 (or 28').

The corrugations 27 and 27' are disposed in alignment with one another and separated by a smooth portion of the spherical dome 25 whose width is about 3 mm for a tool having a diameter of 13.5 mm.

The corrugations 27 and 27' have a longitudinal section in the shape of an arc of a circle and a cross section in the shape of a triangle having a rounded apex.

The height of the corrugations and the distance between the crests of these corrugations are respectively 0.6 mm and 2 mm in the case of a composite tool having a diameter of 19 mm for drilling oil wells.

The tools or tool elements according to the second and third embodiments have advantages over the tool according to the first embodiment shown in FIGS. 1 and 2, as concerns the efficiency of the cooling by the cutting fluid, the increase in the cutting pressure points and the breaking up of the cuttings or fragments of material torn away during the machining. These advantages may even be enhanced in some cases of use, owing to the spherical dome shape of the working surface or its envelope.

The tool or tool element according to the invention may be formed by one of the two methods which will now be described.

The tool or the tool element according to the invention may be produced from a composite tool comprising a cemented carbide support and a polycrystalline diamond active part having a smooth working surface.

Such tools, known in the art, are produced by sintering diamond particles at high temperature and very high pressure in the presence of a binder and catalyst metal such as cobalt and in contact with a support material of metal carbide enclosing a binder metal.

Such a tool may be shaped in the course of the sintering in order to obtain a working surface or table of any shape, for example a working surface of planar or spherical dome shape.

In starting with such a tool or tool element obtained in the conventional manner, the tool according to the invention is produced by machining the diamond-impregnated working surface or table of planar shape (in the case of the first, embodiment of the invention) or of crowned shape (in the case of the second and third embodiments of the invention).

The machining and the shaping of the diamond-impregnated working surface of the tool for producing successive and substantially parallel corrugations on this working surface, are carried out by electro-erosion by using an electrode wire which machines the hollow portions between the corrugations, or a staving-in electrode which is shifted along the direction of the hollow portions between the corrugations.

The tool or tool element according to the invention may also be produced directly by sintering in a high pressure and high temperature device of the same type as the devices employed for producing by sintering tools of conventional shape having a smooth working surface.

There is employed a cup of refractory metal, such as molybdenum or a molybdenum and zirconium alloy, whose internal volume defines the shape of the tool to be produced. The cup has an internal surface defining the inner end thereof on which are formed substantially parallel corrugations which define projecting portions and hollow portions on this bottom.

The hollow portions machined in the bottom of the cup correspond, in shape and dimensions, to the corrugations to be produced on the diamond-impregnated workin9 surface of the tool. The projecting portions correspond to the hollow portions between the corrugations.

Placed in the bottom of the cup, in contact with the machined surface thereof, is an amount of an abrasive mixture constituted by diamond particles mixed with a metal which acts as a binder and catalyst, such a cobalt. The abrasive mixture is evenly spread over the entire surface of the cup so as to fill the hollow portions between the corrugations and constitute (bearing in mind the expected shrinkage in the course of the subsequent compacting and sintering) an active part of the tool having a required dimension.

There is then placed, on top of the abrasive mixture carefully distributed in the bottom of the cup, a cemented tungsten carbide support, for example constituted by tungsten carbide particles cemented with cobalt.

Before placing the tungsten carbide support on the layer of the abrasive mixture, there may be disposed on the latter a diffusion barrier constituted by a mixture of tungsten carbide powder and the abrasive mixture adapted to constitute the active part of the tool.

In this way there is achieved, by pressing in the cold state under very high pressure, densification of the abrasive mixture and optionally the diffusion barrier.

There is then carried out the sintering of the whole of the support, of the active part and optionally of the diffusion barrier under pressure higher than 35 kbars and a temperature higher than 1,000° C. in the zone of the stability of the cubic phase of the carbon.

This sintering operation is pursued for 3 to 30 minutes. Care is taken to maintain the pressure on the part to be sintered during the rise and drop in temperature.

The part constituting the tool or the tool element is then withdrawn and put into the final shape by planar or cylindrical grinding.

In order to improve the connection between the polycrystalline diamond active part and the metal carbide support, there may be interposed, between these two components, a layer of material adapted to constitute the metallurgical junction layer after sintering.

In the case of a polycrystalline diamond active part cemented with cobalt, this layer adapted to constitute the metallurgical connection layer may be forced by cobalt deposited on the metal carbide support or placed on top of the abrasive mixture layer.

This connection layer may also be formed from the diffusion barrier constituted by a mixture of tungsten carbide powder and the abrasive mixture adapted to form the active part of the tool.

The metal element, such as the cobalt constituting both a binder and a catalyst for the diamond-impregnated abrasive product, may be previously mixed with the abrasive powder constituted by diamond or deposited on the surface of the tungsten carbide support coming in contact with the abrasive mixture before sintering.

In the case where the active part is constituted by polycrystalline diamond cemented with cobalt and where the support is of tungsten carbide also including a certain quantity of cobalt as the binder element, the cobalt serving as the binder and catalyst may be introduced in the abrasive mixture put in contact with the tungsten carbide support from this support and by infiltration. In this case, it is unnecessary to add further cobalt in the mixture or on the contact surface of the support, the support enclosing an excess amount of cobalt which is capable of being diffused in the abrasive mixture when sintering.

In any case, the tool according to the invention may be simply obtained by operations which are known in the field of the manufacture of carbide tools having a diamond-impregnated working surface.

The tool or tool element according to the invention, however, has important advantages over tools of the prior art inasmuch as the cutting efforts and the heating of the tool are much lower and, at the same time, the efficiency of the cooling fluid is considerably improved. There result an extremely large decrease in the thermal degradation of the tool in use, distinctly improved efficiency, prolonged life and conditions of utilization which permit reducing the machining times and stoppages for maintenance or repairs.

The working it is possible to imagine tools whose working surface of the tool may have a general shape different from the planar or crowned shape described and illustrated hereinabove.

The corrugations may have, in longitudinal section or cross section,, shapes different from those described, as well as any height or spacing, depending on the intended utilization, the size of the tool, its manner of operating and the type of material to be machined.

Although the invention has very advantageous applications in the case of the working of rocks and in particular drilling to great depth, such as drilling oil wells, it is also useful for cutting and excavating machines in mining or in machine tools for machining metals, hard materials or any other type of materials whose machining requires good cooling of the tool and involves cutting efforts which may be considerable.

We claim:

1. Composite tool comprising a metal carbide support and a polycrystalline diamond active part having an inner surface of metallurgical connection to said support and an outwardly facing working surface, said working surface comprising corrugations which are substantially parallel with one another and constitute successive projecting zones and hollow zones and an outer end portion of said active part of said tool being located on a spherical dome surface, said spherical dome surface comprising said corrugations being disposed in two peripheral zones and a smooth surface in a central zone of said spherical dome surface.

2. Composite tool according to claim 1, wherein said corrugations have in cross section a shape of a triangle with a rounded apex.

3. Composite tool according to claim 1, wherein said active part comprises diamond particles bonded together with cobalt and said support comprises a mixture of tungsten carbide particles sintered and bonded together with cobalt.

4. Composite tool according to claim 1, comprising an inner metallurgical connection layer composed of polycrystalline diamond and metal carbide constituting a diffusion barrier.

* * * * *